US005255918A

United States Patent [19]

Anderson et al.

[11] Patent Number: 5,255,918

[45] Date of Patent: Oct. 26, 1993

[54] GOLF CLUB HEAD AND METHOD OF FORMING SAME

[75] Inventors: Donald A. Anderson, 6600 Werner Ave., #150, Huntington Beach, Calif. 92648; Donald J. C. Sun, 4521 Ocean Valley La., San Diego, Calif. 92130

[73] Assignees: Donald A. Anderson, Huntington Beach, ; a part interest; Donald J. C. Sun, San Diego, both of Calif. ; a part interest

[21] Appl. No.: 937,178

[22] Filed: Aug. 31, 1992

Related U.S. Application Data

[63] Continuation-in-part of Ser. No. 897,005, Jun. 11, 1992, which is a continuation-in-part of Ser. No. 806,398, Dec. 13, 1991, which is a continuation-in-part of Ser. No. 549,973, Jul. 9, 1990, Pat. No. 5,094,383, which is a continuation-in-part of Ser. No. 492,973, Mar. 13, 1990, Pat. No. 5,024,437, which is a continuation-in-part of Ser. No. 364,698, Jun. 12, 1989, abandoned.

[51] Int. Cl.[5] ..... A63B 53/04

[52] U.S. Cl. ..... 273/167 H; 273/78; 273/173; 273/167 J

[58] Field of Search ..... 273/167 R–77 A, 273/164.1, 77 R, 187.4, 186.1, DIG. 23, 193 R, 194 R, 78

[56] References Cited

U.S. PATENT DOCUMENTS

| | | | |
|---|---|---|---|
| 1,257,471 | 2/1918 | Fitzjohn et al. | 273/173 |
| 1,359,220 | 11/1920 | Beamer | 273/78 |
| 1,463,533 | 7/1923 | Kurz, Jr. | 273/173 |
| 1,589,363 | 6/1926 | Butchart | 273/173 |
| 1,665,523 | 4/1928 | Boyce | 273/173 |
| 2,034,936 | 3/1936 | Barnhart | 273/78 |
| 2,447,967 | 8/1948 | Stone | 273/78 |
| 2,517,245 | 8/1950 | Scott | 273/77 R |
| 3,218,072 | 11/1965 | Burr | 273/78 |
| 3,387,844 | 6/1968 | Shippee | 273/77 R |
| 3,970,236 | 7/1976 | Rogers | 273/173 |
| 4,027,885 | 6/1977 | Rogers | 273/169 |
| 4,252,262 | 2/1981 | Igarashi | 273/173 X |
| 4,398,965 | 8/1983 | Campau | 273/78 |
| 4,432,549 | 2/1984 | Zebelean | 273/167 H |
| 4,438,931 | 3/1984 | Motomiya | 273/176 H |
| 4,465,221 | 8/1984 | Schmidt | 273/173 |
| 4,534,558 | 8/1985 | Yoneyama | 273/78 |
| 4,749,197 | 6/1988 | Orlowski | 273/173 |
| 4,754,969 | 7/1988 | Kobayashi | 273/77 A |
| 4,768,787 | 9/1988 | Shira | 273/175 |
| 4,792,140 | 12/1988 | Yamaguchi et al. | 273/173 |
| 4,804,188 | 2/1989 | McKee et al. | 273/167 R |
| 4,809,978 | 3/1989 | Yamaguchi et al. | 273/78 |
| 4,824,116 | 4/1989 | Nagamoto et al. | 273/171 |
| 4,883,275 | 11/1989 | Boone | 273/172 |
| 5,024,437 | 6/1991 | Anderson | 273/78 |
| 5,094,383 | 3/1982 | Anderson et al. | 228/176 |

FOREIGN PATENT DOCUMENTS

| | | | |
|---|---|---|---|
| 211781 | 12/1957 | Australia | 273/167 F |
| 62-7474 | 9/1987 | Japan . | |
| 64-85679 | 3/1989 | Japan . | |
| 3822 | of 1893 | United Kingdom | 273/78 |
| 15376 | 1/1903 | United Kingdom | 273/167 J |
| 15260 | of 1904 | United Kingdom | 273/78 |
| 243435 | 11/1925 | United Kingdom | 273/164.1 |
| 267755 | 3/1927 | United Kingdom . | |
| 379032 | 8/1932 | United Kingdom | 273/78 |
| 442557 | 2/1936 | United Kingdom | 273/80 R |
| 1227948 | 4/1971 | United Kingdom . | |
| 2146249 | 4/1985 | United Kingdom | 273/173 |

OTHER PUBLICATIONS

PCT/US91/01668 filed Mar. 12, 1991, Gear Fit Golf, Inc.

Dennis, Larry "What Irons Are Best for You—Forged or Cast?" *Golf Digest*, Jan. 1975, pp. 40–46.

*Primary Examiner*—V. Millin

*Assistant Examiner*—Sebastiano Passaniti

*Attorney, Agent, or Firm*—William W. Haefliger

[57] ABSTRACT

A golf club head comprising a main body portion formed by a steel casting; a face plate formed of forged steel, and having a periphery, a ball striking front face, and a rear side; provisions for joining the periphery of the face plate at the main body portion to form a high strength, forged face plate for the golf club head; and the main body portion forming a first rearwardly re-entrant recess directly communicating with the face plate rear side over the major area of the rear side. The face plate may alternatively consist of consolidated metal powder.

12 Claims, 1 Drawing Sheet

GOLF CLUB HEAD AND METHOD OF FORMING SAME

BACKGROUND OF THE INVENTION

This application is a continuation in part of Ser. No. 897,005 filed Jun. 11, 1992, which is a continuation in part of Ser. No. 806,348, filed Dec. 13, 1991; which is a continuation in part of application Ser. No. 549,973, filed Jul. 9, 1990, now U.S. Pat. No. 5,094,383, which is a continuation in part of application Ser. No. 492,973, filed Mar. 13, 1990, now U.S. Pat. No. 5,024,437, issued Jun. 18, 1991; which is a continuation in part of Ser. No. 364,698, filed Jun. 12, 1989, now abandoned. All of such applications and resulting patents are incorporated herein by reference.

This invention relates to golf clubs, and more particularly to an improved face plate construction for and attachment to a golf club head.

The heads of golf clubs are generally formed as a one-piece casting of durable materials, such as stainless steel, beryllium copper, aluminum, etc. A head of this type is described in U.S. Pat. No. 4,021,047 issued May 3, 1977 to R. J. Mader. The use of face plates made of a different material than that of the main body of the club head has been disclosed in the prior art in both irons and "wood"-type drivers, which are often made of cast metal. Such prior art club heads are described in U.S. Pat. No. 4,792,140 issued Dec. 20, 1988, to Yamaguchi et al; U.S. Pat. No. 4,534,558 issued Aug. 13, 1985 to Yoneyama; U.S. Pat. No. 3,218,072 issued Nov. 16, 1965, to Burr; and British Patent No. 1,227,948 issued Apr. 15, 1971, to Haines et al.

In the heads of these prior art patents, the face plate is of a plastic material, such as a resin or a carbon fiber composite. There is need for a high-strength, controlled thickness, metallic face plate of selected composition, at the face of the head, the head itself consisting of metal.

SUMMARY OF THE INVENTION

It is a major object of the invention to provide an improved golf club head, comprising a) a main body portion formed by a metal casting, b) a face plate formed of forged steel, and having a periphery, a ball striking front face, and a rear side, c) means joining the periphery of the face plate to the main body portion to form a high strength, forged face plate for the golf club head, d) said main body portion forming a first rearwardly re-entrant recess directly communicating with the face plate rear side over the major area of the rear side.

As will appear, the main body portion is selected from the group consisting of steel, titanium, beryllium, copper and aluminum, and alloys thereof.

It is another object of the invention to provide a completely enclosed recess at the rear of the face plate, the periphery of the latter extending in looping configuration which is everywhere offset from said recess. Also, the main body portion typically defines a looping ledge which faces forwardly and seats the face plate proximate the periphery thereof.

Yet another object is to provide an improved head wherein the face plate periphery has top and bottom elongated extents, one of which is longer than the other. In this regard weld means at the plate periphery may have generally trapezoidal configuration.

A further object is the provision of a head as defined which is a golf club iron, with a forged face plate having thickness between 1/32 to 1 inch. In addition the ball striking surface may have tungsten carbide particle blasted surface irregularity.

Another object is the provision of a face plate as defined, wherein the metal of the face plate consists of consolidated metal powder, such as steel powder.

These and other objects and advantages of the invention, as well as the details of an illustrative embodiment, will be more fully understood from the following specification and drawings, in which:

DRAWING DESCRIPTION

DETAILED DESCRIPTION

Figure 1:
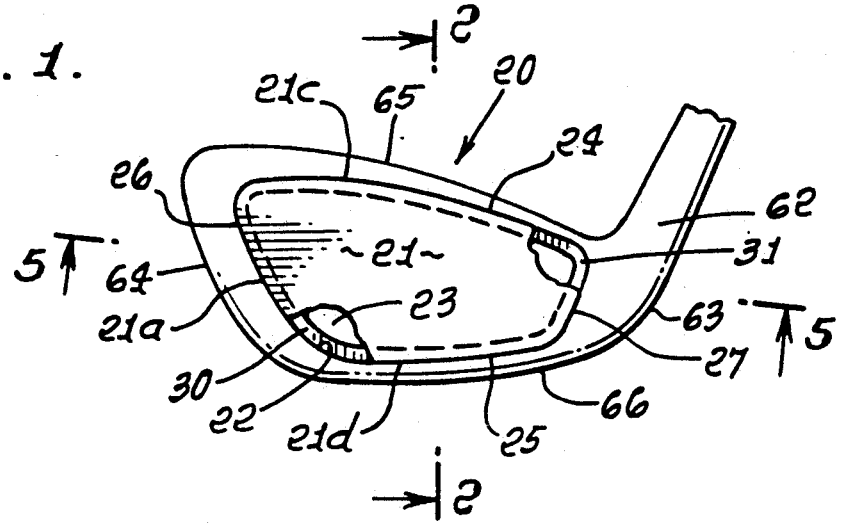
FIG. 1 is an elevation showing an iron head incorporating the invention.
Figure 3:
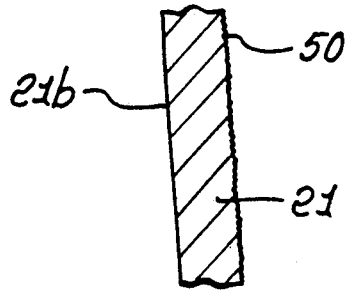
FIG. 3 is a further enlarged section showing face plate construction.
Figure 2:
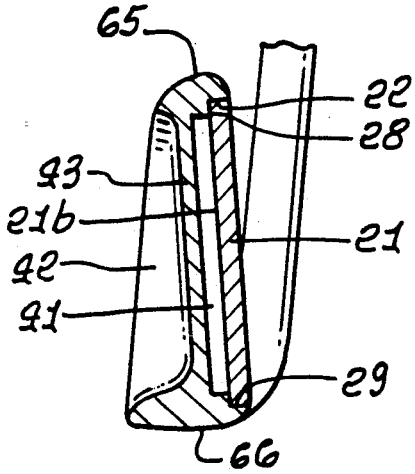
FIG. 2 is an enlarged section taken on lines 2—2 of FIG. 1.
Figure 4:
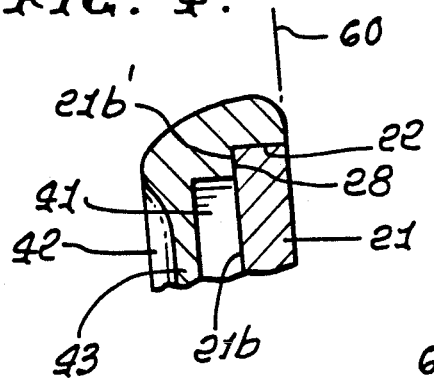
FIG. 4 is an enlarged section showing weld attachment of the face plate to the head, and a grinding step.
Figure 5:
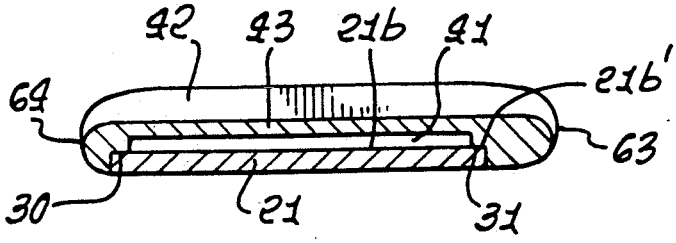
FIG. 5 is a section taken on lines 5—5 of FIG. 1.

Referring to FIGS. 1–4, a metal wood golf club head has a main body portion 20 of a first metallic material. It may be formed of investment casting material, such as stainless steel, beryllium copper, titanium, aluminum, etc. The face plate 21 is formed from a second metallic material, and may be forged for high strength. Preferably, the face plate metal is the same as the main body metal, both typically consisting of stainless steel. The face plate 21 is peripherally abutted against front ledge surfaces of the body and solidly joined to the latter by welding stretches indicated at 24–27, integrating the face plate and body portions. The face plate may alternatively consist of consolidated metal powder, the consolidation process described in U.S. Pat. Nos. 3,356,496 and 3,689,259.

In the example, the plate 21 has a looping periphery 21*a* fitting closely to or adjacent the looping wall 22 of a front opening 23 in the body, welds 24–27 attaching the face plate to seat at ledges 28–31 integral with the body, whereby a high-strength, failure resistant club head (iron) is thereby formed. The face plate looping periphery is upwardly convex at edge 21*c*, downwardly convex at edge 21*d*, and is generally trapezoidal.

Ledges 28–31 are typically formed during casting of body 20, and they seat the periphery 21*b*' of the rear side 21*b* of the face plate. The plate itself is between 1/32 inch and 1 inch thick.

In accordance With an important aspect of the invention, the main body portion 20 forms a first rearwardly re-entrant recess 41 directly communicating with the face plate rear side 21*b*, over the major area of said plate rear side. Recess 41 is closed when plate 21 is attached. Accordingly, the space 41 allows rearward deflection of the main extent of the plate 21, inwardly of ledges 28–31, during high speed plate impact with a golf ball. Note also a second and forwardly re-entrant recess 42 at the rear of the head, body wall 43 extending between recesses 41 and 42. Recess 41 is enclosed.

Note further that the face plate periphery extends in looping configuration which is everywhere offset from said recess; also, the main body portion 20 defines a looping ledge which faces forwardly and seats said face plate proximate the periphery thereof. In addition, the face plate projects toward the top and bottom levels of the head, and toward the toe and heel of the head. The face plate periphery, and the looping welding stretches 24–27, have generally trapezoidal configuration.

Finally, the face of the face plate 21 has tungsten carbide particle blasted surface irregularity, for extreme hardening. See surface irregularity 50 in FIG. 3. The plane of grinding of the face plate and body 20 is seen at 60 in FIG. 4.

The principles of the invention may also be applied to a metal wood.

Additional head elements are as follows:

hosel 62 heel 63 toe 64 top 65 bottom or sole 66

I claim:

1. A golf club head comprising a) a main body portion formed by a metal casting, b) a face plate formed of forged metal, and having a periphery, a ball striking front face, and a rear side, c) means joining said periphery of said face plate to said main body portion to form a high strength, forged face plate for said golf club head, d) said main body portion forming a first rearwardly re-entrant recess directly communicating with said face plate rear side over the major area of said rear side, said face plate being the only forged component of said head, e) wherein said main body portion and said face plate completely enclose said recess, f) and said main body portion forming a second re-entrant recess at the rear side of the head, and a wall separating said first and second re-entrant recesses.

2. A golf club head of claim 1 wherein said face is provided with a surface irregularity formed by blasting of the surface with tungsten carbide particles.

3. The golf club head of claim 1 wherein said face plate periphery extends in a looping configuration which is everywhere offset from said recess.

4. The golf club head of claim 2 wherein said main body portion defines a looping ledge which faces forwardly and seats said face plate proximate the face plate periphery.

5. The golf club head of claim 1 wherein the head has top and bottom levels, a toe and a heel, and wherein said face plate projects toward the top and bottom levels of the head, and toward the toe and heel of the head.

6. The golf club head of claim 5 wherein said face plate periphery has top and bottom elongated extents, one of which is longer than the other.

7. The golf club head of claim 1 wherein said means joining said periphery of the face plate to the head main body portion comprises weld means that has generally trapezoidal configuration.

8. The golf club head of claim 1 wherein said forged face plate has a thickness between 1/32 inch and 1 inch.

9. The golf club head of claim 1 which defines an iron.

10. The golf club head of claim 1 wherein said face is provided with a surface irregularity formed by blasting of the surface with tungsten carbide particles.

11. The golf club head of claim 1 wherein the material from which the main body portion is cast is selected from the group consisting of steel, titanium, beryllium, copper and aluminum, and alloys thereof.

12. A golf club head comprising a) a main body portion formed by a steel casting, b) a face plate formed of consolidated metal powder, and having a periphery, a ball striking front face, and a rear side, c) means joining said periphery of said face plate to said main body portion to form a high strength face plate for said golf club head, d) said main body portion forming a first rearwardly re-entrant recess directly communicating with said face plate rear side over the major area of said rear side, e) said face plate being the only consolidated metal component of said head, f) there being a second re-entrant recess rearwardly of the first re-entrant recess, and formed by the head.

* * * * *